US009624445B2

(12) United States Patent
Van den Berg et al.

(10) Patent No.: US 9,624,445 B2
(45) **Date of Patent: *Apr. 18, 2017**

(54) IMPROVEMENTS RELATING TO COAL TO LIQUID PROCESSES

(75) Inventors: Robert Erwin Van den Berg, Amsterdam (NL); Johannes Margaretha Anna Joan Van Montfort, Amsterdam (NL); Jacobus Hendrikus Scheerman, Amsterdam (NL); Johannes Gerardus Maria Schilder, Amsterdam (NL)

(73) Assignee: SHELL OIL COMPANY, Houston, TX (US)

( * ) Notice: Subject to any disclaimer, the term of this patent is extended or adjusted under 35 U.S.C. 154(b) by 1495 days.

This patent is subject to a terminal disclaimer.

(21) Appl. No.: 12/089,774

(22) PCT Filed: Oct. 13, 2006

(86) PCT No.: PCT/EP2006/067378

§ 371 (c)(1),
(2), (4) Date: Jun. 30, 2008

(87) PCT Pub. No.: WO2007/042564

PCT Pub. Date: Apr. 19, 2007

(65) Prior Publication Data

US 2008/0256861 A1 Oct. 23, 2008

(30) Foreign Application Priority Data

Oct. 14, 2005 (EP) ..... 05109559

(51) Int. Cl.
*C10J 3/84* (2006.01)
*C10J 3/78* (2006.01)
(Continued)

(52) U.S. Cl.
CPC ..... *C10J 3/84* (2013.01); *C10J 3/485* (2013.01); *C10J 3/506* (2013.01); *C10J 3/78* (2013.01);
(Continued)

(58) Field of Classification Search
USPC ..... 48/197 R
See application file for complete search history.

(56) References Cited

U.S. PATENT DOCUMENTS 3,976,442 A 8/1976 Paull et al. ..... 48/197
3,976,443 A 8/1976 Paull et al. ..... 48/197 R
(Continued)

FOREIGN PATENT DOCUMENTS

DE 2610982 9/1977 ..... C10K 1/16
DE 4336790 5/1995 ..... B01D 53/14
(Continued)

OTHER PUBLICATIONS

Perry, Chemical Engineerings' Handbook, Section 14, Gas Absorption and Gas Liquid System Design, pp. 14-1-14-37.
(Continued)

*Primary Examiner* — Matthew Merkling

(57) ABSTRACT

Process for preparing a hydrocarbon product from a solid carbonaceous fuel (8), the process at least comprising the steps of: (a) supplying a solid carbonaceous fuel (8) and an oxygen containing stream (9) to a burner of a gasification reactor (10), wherein a $CO_2$ containing transport gas (30, 32) is used to transport the solid carbonaceous fuel (8) to the burner wherein the weight ratio of $CO_2$ to the carbonaceous fuel in step (a) is less than 0.5 on dry basis.; (b) partially oxidising the carbonaceous fuel in the gasification reactor, thereby obtaining a gaseous stream at least comprising CO, $CO_2$, and $H_2$ (11); (c) removing the gaseous stream obtained in step (b) from the gasification reactor; (d) optionally shift
(Continued)

converting (16) at least part of the gaseous stream as obtained in step (c) thereby obtaining a CO depleted stream, (e) subjecting the gaseous stream of step (c) and/or the optional CO depleted stream of step (d) to a Fischer-Tropsch reaction to obtain a hydrocarbon product (24).

21 Claims, 3 Drawing Sheets

(51) Int. Cl.

| | |
|---|---|
| ***C10K 1/08*** | (2006.01) |
| ***C10K 3/06*** | (2006.01) |
| ***C10J 3/48*** | (2006.01) |
| ***C10J 3/50*** | (2006.01) |

(52) U.S. Cl.

CPC ..... *C10K 1/08* (2013.01); *C10K 3/06* (2013.01); *C10J 2200/15* (2013.01); *C10J 2200/156* (2013.01); *C10J 2300/0903* (2013.01); *C10J 2300/093* (2013.01); *C10J 2300/0943* (2013.01); *C10J 2300/0969* (2013.01); *C10J 2300/1223* (2013.01); *C10J 2300/1659* (2013.01); *C10J 2300/1807* (2013.01); *C10J 2300/1846* (2013.01)

(56) References Cited

U.S. PATENT DOCUMENTS

| | | | | |
|---|---|---|---|---|
| 4,017,271 | A | 4/1977 | Barclay et al. | |
| 4,776,860 | A * | 10/1988 | Najjar et al. | 48/197 R |
| 4,801,440 | A | 1/1989 | Najjar et al. | 423/415 A |
| 5,827,902 | A * | 10/1998 | Maretto et al. | 518/706 |
| 6,596,781 | B1 * | 7/2003 | Schinski | 518/700 |
| 6,759,440 | B2 | 7/2004 | Geerlings et al. | 518/715 |
| 6,933,324 | B2 | 8/2005 | Stamires et al. | 518/719 |
| 6,976,362 | B2 | 12/2005 | Sheppard et al. | 60/780 |
| 2003/0036572 | A1 * | 2/2003 | Shiroto et al. | 518/704 |
| 2003/0045764 | A1 | 3/2003 | Brown et al. | 585/638 |
| 2003/0181535 | A1 | 9/2003 | Van Hardeveld et al. | 518/715 |
| 2004/0256116 | A1 | 12/2004 | Olsvik et al. | 166/401 |
| 2005/0196332 | A1 | 9/2005 | Demirel et al. | 422/285 |
| 2005/0203194 | A1 | 9/2005 | Botes et al. | 518/716 |
| 2005/0250862 | A1 | 11/2005 | Bayle et al. | 518/702 |
| 2006/0045827 | A1 | 3/2006 | Sprouse | 422/188 |
| 2006/0096298 | A1 | 5/2006 | Barnicki et al. | 60/781 |

FOREIGN PATENT DOCUMENTS

| | | | |
|---|---|---|---|
| DE | 102004053494 | 5/2006 | C10J 3/00 |
| EP | 0444684 | 9/1991 | C10J 3/02 |
| EP | 450861 | 10/1991 | C07C 1/04 |
| EP | 0450861 | 10/1991 | |
| EP | 510771 | 10/1992 | B01J 37/00 |
| EP | 0510771 | 10/1992 | |
| EP | 651042 | 10/1994 | C10K 1/16 |
| EP | 0651042 | 5/1995 | |
| EP | 1509323 | 3/2005 | B01J 37/04 |
| JP | 51083602 | 7/1976 | |
| JP | 114009 | 5/1986 | |
| JP | 05202892 | 8/1993 | |
| JP | 228807 | 9/1997 | |
| JP | 2001-279266 | 10/2001 | |
| WO | WO0176736 | 10/2001 | B01J 23/74 |
| WO | WO0202489 | 1/2002 | C07C 1/04 |
| WO | WO0207882 | 1/2002 | B01J 37/02 |

OTHER PUBLICATIONS

Hamelinck C N et al: "Future prospects for production of methanol and hydrogen from biomass" Journal of Power Sources, Elsevier, Amsterdam, NL, vol. 111, No. 1, Sep. 18, 2002 (Sep. 18, 2002), pp. 1-22, XP004380118. ISSN: 0378-7753. The whole document.

Van Den Burgt Literature; Development of the Shell Coal Gasification Process, (published in the proceedings of the third BOC Priestley Conference, held in Sep. 1983 in London).

Perry Chemical Engineerings' Handbook, Section 14, Gas Absorption and Gas Liquid System Design, pp. 14-1/14-37.

* cited by examiner

IMPROVEMENTS RELATING TO COAL TO LIQUID PROCESSES

PRIORITY CLAIM

The present application claims priority to European Patent Application 05109559.4 filed 14 Oct. 2005.

TECHNICAL FIELD OF THE INVENTION

The present invention relates to improvements relating to the use of coal and other heavy hydrocarbonaceous feedstocks in Fischer-Tropsch processes.

BACKGROUND OF THE INVENTION

The Fischer-Tropsch process can be used for the conversion of hydrocarbonaceous feedstocks into liquid and/or solid hydrocarbons. The feedstock (e.g. natural gas, associated gas, coal-bed methane, biomass, heavy oil residues, coal) is converted in a first step into a mixture of hydrogen and carbon monoxide (this mixture is often referred to as synthesis gas or syngas). The synthesis gas is then fed into a reactor where it is converted over a suitable catalyst at elevated temperature and pressure into paraffinic compounds ranging from methane to high molecular weight molecules comprising up to 200 carbon atoms, or, under particular circumstances, even more. Examples of the Fischer-Tropsch process are described in e.g. WO-A-02/02489, WO-A-01/76736, WO-A-02/07882, EP-A-510771 and EP-A-450861.

Numerous types of reactor systems have been developed for carrying out the Fischer-Tropsch reaction. For example, Fischer-Tropsch reactor systems include fixed bed reactors, especially multi-tubular fixed bed reactors, fluidised bed reactors, such as entrained fluidised bed reactors and fixed fluidised bed reactors, and slurry bed reactors such as three-phase slurry bubble columns and ebulated bed reactors.

As mentioned above, "coal" and heavy oil residues are examples of feedstocks for the Fischer-Tropsch process. However, there are many solid fossil fuels which may be used as feedstock for the process, including solid fuels such as anthracite, brown coal, bitumous coal, sub-bitumous coal, lignite, petroleum coke, peat and the like. All such types of fuels have different levels of 'quality', that is the proportions of hydrogen and carbon and, as well as substances regarded as 'impurities', generally sulfur and sulfur-based compounds, nitrogen containing compounds, ash, heavy metals etc.

Gasification of solid carbonaceous fuels such as coal is well known, and generally involves milling or otherwise grinding the fuel to a preferred size or size range, followed by reacting the fuel with oxygen in a gasifier. This creates the mixture of hydrogen and carbon monoxide referred to as syngas or synthesis gas. In many known processes, $N_2$ is used as a transport gas for transporting the coal to the burner of the gasification reactor. A problem of the use of $N_2$ as a transport gas is that the $N_2$, although relatively inert, may lead to undesirably reducing the efficiency of the downstream catalysts. Moreover the presence of nitrogen will require more reactor volume for performing the Fischer-Tropsch synthesis at the same production capacity, especially when a synthesis gas recycle over the Fischer-Tropsch reactor is used.

U.S. Pat. No. 3,976,442 describes a process wherein a solid carbonaceous fuel is transported in a $CO_2$ rich gas to a burner of a pressurized gasification reactor operating at about 50 bar. According to the examples of this publication a flow of coal and carbon dioxide at a weight ratio of $CO_2$ to coal of about 1.0 is supplied to the annular passage of the annular burner at a velocity of 150 ft/sec. Oxygen is passed through the centre passage of the burner at a temperature of 300° F. and a velocity of 250 ft/sec. U.S. Pat. No. 3,976,442 thus provides a process wherein the partial oxidation is performed in a pressurized reactor and wherein the use of nitrogen as transport gas is avoided. Nevertheless the use of carbon dioxide as transport gas was never practiced or seriously considered in the intermediate 30 years. This was probably due to the low carbon efficiency of the process as disclosed by this publication. The low efficiency of the coal to the synthesis gas will ultimately effect the efficiency of the total process starting from coal to the products as obtained from the Fischer-Tropsch process.

SUMMARY OF THE INVENTION

One or more of the above or other objects are achieved by the present invention by providing a process for preparing a hydrocarbon product from a solid carbonaceous fuel, the process at least comprising the steps of:

(a) supplying a solid carbonaceous fuel and an oxygen containing stream to a burner of a gasification reactor, wherein a $CO_2$ containing transport gas is used to transport the solid carbonaceous fuel to the burner wherein the weight ratio of $CO_2$ to the carbonaceous fuel in step (a) is less than 0.5 on dry basis.;

(b) partially oxidising the carbonaceous fuel in the gasification reactor, thereby obtaining a gaseous stream at least comprising CO, $CO_2$, and $H_2$;

(c) removing the gaseous stream obtained in step (b) from the gasification reactor;

(d) optionally shift converting at least part of the gaseous stream as obtained in step (c) thereby obtaining a CO depleted stream, (e) subjecting the gaseous stream of step (c) and/or the optional CO depleted stream of step (d) to a Fischer-Tropsch reaction to obtain a hydrocarbon product.

Applicants found that by using the relatively low weight ratio of $CO_2$ to the carbonaceous fuel in step (a) less oxygen is consumed during the process and a higher selectivity to carbon monoxide and hydrogen is achieved as compared to the process of U.S. Pat. No. 3,976,442. This enhances the total efficiency of the process according to the present invention significantly. Moreover by not using nitrogen as the carrier gas a lower volume of inert gas is provided to the Fischer-Tropsch step (e), which is advantageous because smaller volume reactors may then be applied. A further advantage is that the $CO_2$ content in the gaseous stream is lower than in U.S. Pat. No. 3,976,442. This is advantageous for the same reasons as for nitrogen. Further it is advantageous in a preferred embodiment of the invention wherein carbon dioxide is separated from the gaseous stream prior to performing step (e). In this embodiment less carbon dioxide needs to be removed from the gaseous stream.

DETAILED DESCRIPTION OF THE INVENTION

Figure 1:
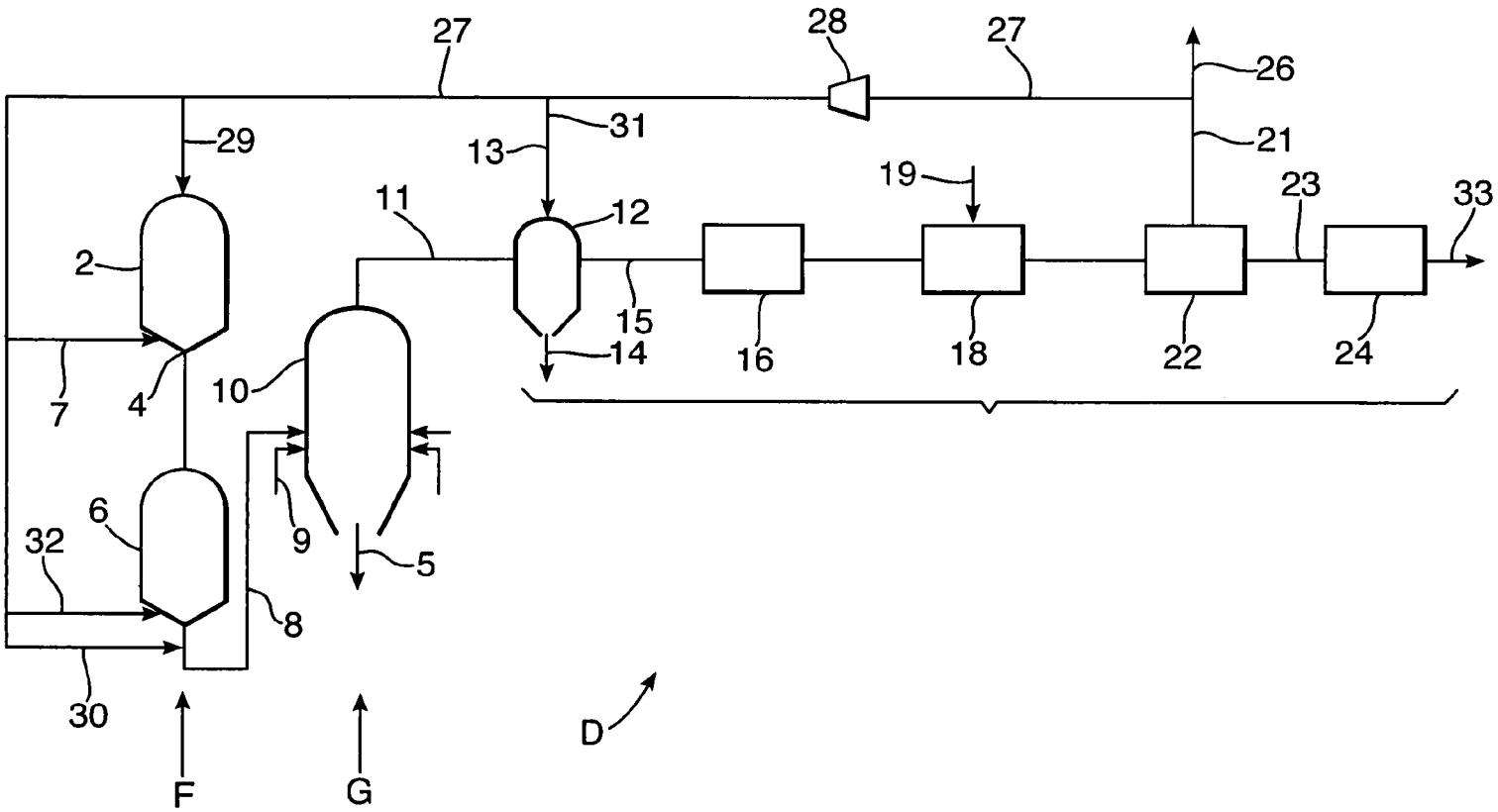
FIG. 1 is a flow diagram illustrating mainly the gasification part of the process according to the invention.

The term solid carbonaceous fuel may be any carbonaceous fuel in solid form. Examples of solid carbonaceous fuels are coal, brown coal, coke from coal, petroleum coke, soot, biomass and particulate solids derived from oil shale, tar sands and pitch. Coal is particularly preferred, and may be of any type, including lignite, sub-bituminous, bituminous and anthracite.

The $CO_2$ containing stream supplied in step (a) may be any suitable $CO_2$ containing stream. Preferably the stream contains at least 80%, preferably at least 95% $CO_2$. Furthermore, the $CO_2$ containing stream is preferably obtained from a downstream processing step as will be discussed below.

As the person skilled in the art is familiar with suitable conditions for partially oxidising a carbonaceous fuel thereby obtaining synthesis gas, these conditions are not further discussed here.

Preferably, the $CO_2$ containing stream supplied in step (a) is supplied at a velocity of less than 20 m/s, preferably from 5 to 15 m/s, more preferably from 7 to 12 m/s. Further it is preferred that the $CO_2$ and the carbonaceous fuel are supplied as a single stream, preferably at a density of from 300 to 600 kg/m$^3$, preferably from 350 to 500 kg/m$^3$, more preferably from 375 to 475 kg/m$^3$.

According to a preferred embodiment of the process of the present invention, the weight ratio of $CO_2$ to the carbonaceous fuel in step (a) is in the range from 0.12-0.49, preferably below 0.40, more preferably below 0.30, even more preferably below 0.20 and most preferably between 0.12-0.20 on a dry basis.

In accordance with the process of the invention the gaseous stream obtained in step (c) will especially comprise from 1 to 10 mol % $CO_2$, preferably from 4.5 to 7.5 mol % $CO_2$ on a dry basis.

Also, it is preferred that the gaseous stream as obtained in step (c) is further processed. Preferably the gaseous stream as obtained in step (c) is subjected to a wet scrubbing optionally preceded by a dry solids removal.

In optional step (d) the gaseous stream as obtained in step (c) is shift converted by at least partially converting CO into $CO_2$, thereby obtaining a CO depleted stream. The shift reaction is especially preferred when in step (e) a cobalt-based catalyst is used. When using such a catalyst an increase in the hydrogen to CO molar ratio is desired. This is because the $H_2$/CO ratio in syngas formed by gasification of most types of carbonaceous fuels defined herein is generally about or less than 1, and is commonly about 0.3-0.6 for coal-derived syngas, and 0.5-0.9 for heavy residue-derived syngas. It is possible to use such a $H_2$/CO ratio in a Fischer-Tropsch process which uses an iron-based Fischer-Tropsch catalyst, although iron-based processes are known which operate at higher $H_2$/CO ratios. For said iron based processes step (d) may thus be omitted.

If step (d) is performed it is preferred to arrive at a $H_2$/CO ratio of the CO depleted stream of between 1.4 and 1.95, preferably greater than 1.5, more preferably in the range 1.6-1.9, and even more preferably in the range 1.6-1.8.

The water shift conversion reaction as performed in step (d) is well known in the art. Generally, water, usually in the form of steam, is mixed with the gaseous stream to form carbon dioxide and hydrogen. The catalyst used can be any of the known catalysts for such a reaction, including iron, chromium, copper and zinc. Copper on zinc oxide is a known shift catalyst. A very suitable source for the water required in the shift reaction is the product water produced in the Fischer-Tropsch reaction. Preferably this is the main source, e.g. at least 80% is derived from the Fischer-Tropsch process, preferably at least 90%, more preferably 100%. Thus the need of an external water source is minimised.

The catalytic water shift conversion reaction of step (d) provides a hydrogen enriched, often highly enriched, syngas, possibly having a $H_2$/CO ratio above 3, more suitably above 5, preferably above 7, more preferably above 15, possibly 20 or even above.

In order to arrive at the desired $H_2$/CO ratio for performing step (e) it is preferred to perform step (d) only on part of the gaseous stream obtained in step (b). In this preferred embodiment the gaseous stream of step (b) is divided into at least two sub-streams, one of which undergoes step (d) to obtain a first CO depleted stream. This first CO depleted stream is combined with the second sub-stream to form a second CO depleted stream.

If desired or necessary, one or more of the sub-stream(s) which are not subjected to step (d) could be used for other parts of the process rather than being combined with the converted sub-stream(s). Preferably part of such sub-stream is for steam or power generation.

Hydrogen is preferably prepared from part of a CO depleted stream, more preferably from the first CO depleted stream. Hydrogen is preferably prepared in a Pressure Swing Adsorption (PSA) unit, a membrane separation unit or combinations of these. The hydrogen manufactured in this way can then be used as the hydrogen source in the hydrocracking of the hydrocarbon products as made in step (e). This arrangement reduces or even eliminates the need for a separate source of hydrogen, e.g. from an external supply, which is otherwise commonly used where available.

The division of the gaseous stream of step (b) into sub-streams can be such so as to create any desired $H_2$/CO ratio following their recombination. Any degree or amount of division is possible. Where the gaseous stream of step (b) is divided into two sub-streams, the division into the sub-streams could be in the range 80:20 to 20:80 by volume, preferably 70:30 to 30:70 by volume, depending upon the desired final $H_2$/CO ratio. Simple analysis of the $H_2$/CO ratios in the second CO depleted stream and knowledge of the desired ratio allows easy calculation of the division. In the case that one stream is to be used as feed for e.g. a second stage of a Fischer-Tropsch process in step (e), this stream will usually be between 10 and 50%, preferably between 20 and 35% of the first CO depleted stream.

The simple ability to change the degree of division into the sub-streams also provides a simple but effective means of accommodating variation in the $H_2$/CO ratio in the gaseous stream as obtained in step (b) which variations are primarily due to variation in feedstock quality. With feedstock quality is here meant especially the hydrogen and carbon content of the original fuel, for example, the 'grade' of coal. Certain grades of coal generally having a higher carbon content will, after gasification of the coal, provide a greater production of carbon monoxide, and thus a lower $H_2$/CO ratio. However, using other grades of coal means removing more contaminants or unwanted parts of the coal, such as ash and sulfur and sulfur-based compounds. The ability to change the degree of division of the fuel-derived syngas stream into the sub-streams allows the process to use a variety of fuel feedstocks, generally 'raw' coal, without any significant re-engineering of the process or equipment to accommodate expected or unexpected variation in such coals.

Preferably the process further comprises the step of subjecting the CO depleted stream as obtained in step (d) to a $CO_2$ recovery system thereby obtaining a $CO_2$ rich stream and a $CO_2$ poor stream and wherein the $CO_2$ poor stream is used in step (e). The $CO_2$ rich stream is preferably partially used as the $CO_2$ containing transport gas in step (a).

The $CO_2$ recovery system is preferably a combined carbon dioxide/hydrogen sulfide removal system, preferably wherein the removal system uses a physical solvent process. The $CO_2$ recovery may be performed on the gaseous stream obtained in step (b), on the sub streams as obtained from the gaseous stream of step (b) or on the combined second CO depleted stream. Preferably the $CO_2$ recovery is performed after performing step (d). More preferably the $CO_2$ recovery from the sub-stream, which stream is not being subjected to step (d), is performed separately from the $CO_2$ recovery from the first CO depleted stream before said streams are combined.

The $CO_2$ recovery removal system may involve one or more removal units. Preferably, at least one such unit is located downstream of step (e), wherein $CO_2$ is removed from the off-gas as separated from the hydrocarbon product as obtained in step (e).

It is preferred to remove at least 80 vol %, preferably at least 90 vol %, more preferably at least 95 vol % and at most 99.5 vol %, of the carbon dioxide present in the CO depleted stream. This avoids the build-up of inserts in the Fischer-Tropsch process of step (e). The $CO_2$ is preferably used in step (a). Excess $CO_2$ is preferably stored in subsurface reservoirs or used more preferably used for enhanced oil or gas recovery or enhanced coal bed methane recovery.

On an industrial scale there are chiefly two categories of absorbent solvents, depending on the mechanism to absorb the acidic components: chemical solvents and physical solvents. Each solvent has its own advantages and disadvantages as to features as loading capacity, kinetics, regenerability, selectivity, stability, corrosivity, heat/cooling requirements etc.

Chemical solvents which have proved to be industrially useful are primary, secondary and/or tertiary amines derived alkanolamines. The most frequently used amines are derived from ethanolamine, especially monoethanol amine (MEA), diethanolamine (DEA), triethanolamine (TEA), diisopropanolamine (DIPA) and methyldiethanolamine (MDEA).

Physical solvents which have proved to be industrially suitable are cyclo-tetramethylenesulfone and its derivatives, aliphatic acid amides, N-methylpyrrolidone, N-alkylated pyrrolidones and the corresponding piperidones, methanol, ethanol and mixtures of dialkylethers of polyethylene glycols.

A well-known commercial process uses an aqueous mixture of a chemical solvent, especially DIPA and/or MDEA, and a physical solvent, especially cyclotetramethylene-sulfone. Such systems show good absorption capacity and good selectivity against moderate investment costs and operational costs. They perform very well at high pressures, especially between 20 and 90 bara.

The physical absorption process is preferred and is well known to the man skilled in the art. Reference can be made to e.g. Perry, Chemical Engineerings' Handbook, Chapter 14, Gas Absorption. The liquid absorbent in the physical absorption process is suitably methanol, ethanol, acetone, dimethyl ether, methyl i-propyl ether, polyethylene glycol or xylene, preferably methanol. This process is based on carbon dioxide and hydrogen sulfide being highly soluble under pressure in the methanol, and then being readily releasable from solution when the pressure is reduced as further discussed below. This high pressure system is preferred due to its efficiency, although other removal systems such as using amines are known. The physical absorption process is suitably carried out at low temperatures, preferably between −60° C. and 0° C., preferably between −30 and −10° C.

The physical absorption process is carried out by contacting the light products stream in a counter-current upward flow with the liquid absorbent. The absorption process is preferably carried out in a continuous mode, in which the liquid absorbent is regenerated. This regeneration process is well known to the man skilled in the art. The loaded liquid absorbent is suitably regenerated by pressure release (e.g. a flashing operation) and/or temperature increase (e.g. a distillation process). The regeneration is suitably carried out in two or more steps, preferably 3-10 steps, especially a combination of one or more flashing steps and a distillation step.

The regeneration of solvent from the process is also known in the art. Preferably, the present invention involves one integrated solvent regeneration tower. Further process conditions are for example described in DE-A-2610982 and DE-A-4336790.

Preferably the gaseous stream the CO depleted stream is subjected to one or more further removal systems prior to using said stream in step (e). These removal systems may be guard or scrubbing units, either as back-up or support to the $CO_2/H_2S$ removal system, or to assist in the reduction and/or removal of other contaminants such as HCN, $NH_3$, COS and $H_2S$, metals, carbonyls, hydrides or other trace contaminants.

Step (e) comprises the well-known Fischer-Tropsch synthesis. The Fischer-Tropsch synthesis is well known to those skilled in the art and involves synthesis of hydrocarbons from a gaseous mixture of hydrogen and carbon monoxide, by contacting that mixture at reaction conditions with a Fischer-Tropsch catalyst.

Products of the Fischer-Tropsch synthesis may range from methane to heavy paraffinic waxes. Preferably, the production of methane is minimised and a substantial portion of the hydrocarbons produced have a carbon chain length of a least 5 carbon atoms. Preferably, the amount of $C_{5+}$ hydrocarbons is at least 60% by weight of the total product, more preferably, at least 70% by weight, even more preferably, at least 80% by weight, most preferably at least 85% by weight. Reaction products which are liquid phase under reaction conditions may be physically separated gas phase products such as light hydrocarbons and water may be removed using suitable means known to the person skilled in the art.

Fischer-Tropsch catalysts are known in the art, and typically include a Group VIII metal component, preferably cobalt, iron and/or ruthenium, more preferably iron and cobalt. The Fischer-Tropsch synthesis may be carried out in a multi-tubular reactor, a slurry phase regime or an ebullating bed regime, wherein the catalyst particles are kept in suspension by an upward superficial gas and/or liquid velocity.

In a preferred embodiment of the invention step (e) is performed by an iron catalyzed Fischer-Tropsch synthesis reaction. More preferably the reaction is performed in a slurry phase reactor or in an ebullating bed regime. Iron based Fischer-Tropsch synthesis is advantageous because a step (d) may be omitted or may have to be applied for only a small side stream to prepare hydrogen. Examples of iron based catalysts and processes are the commercial Sasol process as operated in South Africa and those described in for example US-A-20050203194, US-A-20050196332, U.S. Pat. Nos. 6,976,362, 6,933,324 and EP-A-1509323. In case a cobalt based catalyst is used to make a very heavy Fischer-Tropsch wax product it is found desirable to use a multi-tubular reactor.

Typically, the catalysts comprise a catalyst carrier. The catalyst carrier is preferably porous, such as a porous inorganic refractory oxide, more preferably alumina, silica, titania, zirconia or mixtures thereof.

The optimum amount of catalytically active metal present on the carrier depends inter alia on the specific catalytically active metal. Typically, the amount of cobalt present in the catalyst may range from 1 to 100 parts by weight per 100 parts by weight of carrier material, preferably from 10 to 50 parts by weight per 100 parts by weight of carrier material.

The catalytically active metal may be present in the catalyst together with one or more metal promoters or co-catalysts. The promoters may be present as metals or as the metal oxide, depending upon the particular promoter concerned. Suitable promoters include oxides of metals from Groups IIA, IIIB, IVB, VB, VIB and/or VIIB of the Periodic Table, oxides of the lanthanides and/or the actinides. Preferably, the catalyst comprises at least one of an element in Group IVB, VB and/or VIIB of the Periodic Table, in particular titanium, zirconium, maganese and/or vanadium. As an alternative or in addition to the metal oxide promoter, the catalyst may comprise a metal promoter selected from Groups VIIB and/or VIII of the Periodic Table. Preferred metal promoters include rhenium, platinum and palladium.

Reference to "Groups" and the "Periodic Table" as used herein relate to the "previous IUPAC form" of the Periodic Table such as that described in the $68^{th}$ edition of the Handbook of Chemistry and Physics (CPC Press).

A most suitable catalyst comprises cobalt as the catalytically active metal and zirconium as a promoter. Another most suitable catalyst comprises cobalt as the catalytically active metal and maganese and/or vanadium as a promoter.

The promoter, if present in the catalyst, is typically present in an amount of from 0.1 to 60 parts by weight per 100 parts by weight of carrier material. It will however be appreciated that the optimum amount of promoter may vary for the respective elements which act as promoter. If the catalyst comprises cobalt as the catalytically active metal and maganese and/or vanadium as promoter, the cobalt: (maganese+vanadium) atomic ratio is advantageously at least 12:1.

The Fischer-Tropsch synthesis is preferably carried out at a temperature in the range from 125 to 350° C., more preferably 175 to 275° C., most preferably 200 to 260° C. The pressure preferably ranges from 5 to 150 bar abs., more preferably from 5 to 80 bar abs.

Step (e) may be a single stage or multi-stage process, each stage having one or more reactors. In a multi-stage process, the hydrogen enriched conversion sub-stream could be combined with syngas prior to one or more of the stages, either directly or indirectly. Different type of catalyst may be used in the different stages. For example the first stage may be performed with a cobalt based catalyst and the second stage with an iron based catalyst. In this manner effective use is made in the second stage of the non-converted synthesis gas of the first stage having a lower $H_2/CO$ ratio.

FIG. 1 schematically shows a process block scheme of the process according to the present invention. For simplicity, valves and other auxiliary features are not shown. The system comprises: a carbonaceous fuel supply system (F); a gasification system (G) wherein a gasification process takes place to produce a gaseous stream of an intermediate product containing synthesis gas; and a downstream system (D). A process path extends through the fuel supply system F and the downstream system D via the gasification system G.

In the described embodiment the fuel supply system F comprises a sluicing hopper 2 and a feed hopper 6. The gasification system G comprises a gasification reactor 10. The fuel supply system is arranged to pass the carbonaceous fuel along the process path into the gasification reactor 10. The downstream system D comprises an optional dry-solids removal unit 12, an optional wet scrubber 16, an optional shift conversion reactor 18, a $CO_2$ recovery system 22, and a Fischer-Tropsch synthesis reactor 24. Preferred details of these features will be provided hereinafter.

The sluicing hopper 2 is provided for sluicing the dry solid carbonaceous fuel, preferably in the form of fine particulates of coal, from a first pressure under which the fuel is stored, to a second pressure where the pressure is higher than in the first pressure. Usually the first pressure is the natural pressure of about 1 atmosphere, while the second pressure will exceed the pressure under which the gasification process takes place.

In a gasification process, the pressure may be higher than 10 atmosphere. In a gasification process in the form of a partial combustion process, the pressure may be between 10 and 90 atmosphere, preferably between 10 and higher than 70 atmosphere, more preferably 30 and 60 atmosphere.

The term fine particulates is intended to include at least pulverized particulates having a particle size distribution so that at least about 90% by weight of the material is less than 90 μm and moisture content is typically between 2 and 12% by weight, and preferably less than about 8%, more preferably less than 5% by weight.

The sluicing hopper 2 discharges into the feed hopper 6 via a discharge opening 4, to ensure a continuous feed rate of the fuel to the gasification reactor 10. The discharge opening 4 is preferably provided in a discharge cone, which in the present case is provided with an aeration system 7 for aerating the dry solid content of the sluicing hopper 2.

The feed hopper 6 is arranged to discharge the fuel via conveyor line 8 to one or more burners provided in the gasification reactor 10. Typically, the gasification reactor 10 will have burners in diametrically opposing positions, but this is not a requirement of the present invention. Line 9 connects the one or more burners to a supply of an oxygen containing stream (e.g. substantially pure O2 or air). The burner is preferably a co-annular burner with a passage for an oxygen containing gas and a passage for the fuel and the transport gas. The oxygen containing gas preferably comprises at least 90% by volume oxygen. Nitrogen, carbon dioxide and argon being permissible as impurities. Substantially pure oxygen is preferred, such as prepared by an air separation unit (ASU). Steam may be present in the oxygen containing gas as it passes the passage of the burner. The ratio between oxygen and steam is preferably from 0 to 0.3 parts by volume of steam per part by volume of oxygen. A mixture of the fuel and oxygen from the oxygen containing stream is then reacted in a reaction zone in the gasification reactor 10.

A reaction between the carbonaceous fuel and the oxygen containing fluid takes place in the gasification reactor 10, producing a gaseous stream of synthesis gas containing at least CO, $CO_2$ and $H_2$. Generation of synthesis gas occurs by partially combusting the carbonaceous fuel at a relatively high temperature somewhere in the range of 1000° C. to 2000° C. and at a pressure in a range of from about 1-70 bar.

Slag and other molten solids can be discharged from the gasification reactor via line 5, after which they can be further processed for disposal.

The feed hopper 6 preferably has multiple feed hopper discharge outlets, each outlet being in communication with at least one burner associated with the reactor. Typically, the pressure inside the feed hopper 6 exceeds the pressure inside the reactor 9, in order to facilitate injection of the powder coal into the reactor.

The gaseous stream of synthesis gas leaves the gasification reactor 10 through line 11 at the top, where it is cooled. Cooling may be performed by direct contacting the hot gas with water in a so-called water quench. Alternatively a syngas cooler (not shown) may be provided downstream of the gasification reactor 10 to have some or most of the heat recovered for the generation of, for instance, high-pressure steam. Eventually, the synthesis gas enters the downstream system D in a downstream path section of the process path, wherein the dry-solids removal unit 12 is optionally arranged.

The dry-solids removal unit 12 may be of any type, including the cyclone type. In the embodiment of FIG. 1, it is provided in the form of a preferred ceramic candle filter unit as for example described in EP-A-551951. Line 13 is in fluid communication with the ceramic candle filter unit to provide a blow back gas pressure pulse at timed intervals in order to blow dry solid material that has accumulated on the ceramic candles away from the ceramic candles. The dry solid material is discharged from the dry-solids removal unit via line 14 from where it is further processed prior to disposal.

Suitably, the blow back gas for the blow back gas pressure pulse is preheated to a temperature of between 200° C. and 260° C., preferably around 225° C., or any temperature close to the prevailing temperature inside the dry-solid removal unit 12. The blow back gas is preferably buffered to dampen supply pressure effects when the blow back system is activated.

The filtered gaseous stream 15, now substantially free from dry-solids, progresses along the downstream path section of the process path through the downstream system, and is fed, optionally via wet scrubber 16 and optional shift conversion reactor 18, to the $CO_2$-recovery system 22. The $CO_2$-recovery system 22 functions by dividing the gaseous stream into a $CO_2$-rich stream and a $CO_2$ poor (but CO- and $H_2$-rich) stream and. The $CO_2$-recovery system 22 has an outlet 21 for discharging the $CO_2$-rich stream and an outlet 23 for discharging the $CO_2$-poor stream in the process path. Outlet 23 is in communication with the Fischer-Tropsch synthesis reactor 24, where the discharged ($CO_2$ poor but) CO- and $H_2$-rich stream can be subjected to the Fischer-Tropsch reaction.

A feedback line 27 is provided to bring a feedback gas from the downstream system D to feedback inlets providing access to one or more other points in the process path that lie upstream of the outlet 21, suitably via one or more of branch lines 7, 29, 30, 31, 32 each being in communication with line 27.

Blowback lines may be provided at the outlet of the gasifier and the inlet of the optional syngas cooler. Such blowback lines, although presently not shown in FIG. 1, would serve to supply blow back gas for clearing local deposits. Line 27 is in communication with outlet 21, to achieve that the feedback gas contains $CO_2$ from the $CO_2$-rich stream. Excess $CO_2$-rich gas may be removed from the cycle via line 26.

A compressor 28 may optionally be provided in line 27 to generally adjust the pressure of the feedback gas. It is also possible to locally adjust the pressure in one or more of the branch lines, as needed, either by pressure reduction or by (further) compression. Another option is to provide two or more parallel feedback lines to be held at mutually different pressures using compression in each of the parallel feedback lines. The most attractive option will depend on the relative consumptions.

Herewith a separate source of compressed gas for bringing additional gas into the process path is avoided. Typically in the prior art, nitrogen is used for instance as the carrier gas for bringing the fuel to and into the gasification reactor 10, or as the blow-back gas in the dry-solids removal unit 12 or as purge gas or aeration gas in other places. This unnecessarily brings inert components into the process path, which adversely affects the Fischer-Tropsch synthesis reactor efficiency.

One or more feedback gas inlets are preferably provided in the fuel supply system such that in operation a mixture comprising the carbonaceous fuel and the feedback gas is formed. Herewith an entrained flow of the carbonaceous fuel with a carrier gas containing the feedback gas can be formed in conveyor line 8 to feed the gasification reactor 10. Examples can be found in the embodiment of FIG. 1, where branch lines 7 and 29 discharge into the sluicing hopper 2 for pressurising the sluicing hopper 2 and/or aerating its content, branch line 32 discharges into the feed hopper 6 to optionally aerate its content, and branch line 30 feeds the feedback gas into the conveyor line 8.

The feedback gas is preferably brought into the process path through one or more sintered metal pads, which can for instance be mounted in the conical section of sluicing hopper 2. In the case of conveyor line 8, the feedback gas may be directly injected.

In addition or instead, one or more feedback gas inlets can be provided in the dry-solids removal unit 12 where it can be utilized as blow-back gas.

Again in addition or instead, one or more feedback gas inlets can be provided in the form of purge stream inlets for injecting a purging portion of the feedback gas into the process path to blow dry solid accumulates such as fly ash back into the gaseous steam.

The $CO_2$-recovery system 22 can alternatively be located upstream, downstream or upstream and downstream of the Fischer-Tropsch synthesis reactor 24.

It is remarked that the feedback inlets can be connected to an external gas supply, for instance for feeding in $CO_2$ or $N_2$ or another suitable gas during a start-up phase of the process. When a sufficient amount of syngas is being produced, the feedback inlet may then be connected to the outlet arranged to discharge the feedback gas containing $CO_2$ from the internally produced $CO_2$-rich stream. Preferably nitrogen is used as external gas for start-up of the process. In start-up situations no carbon dioxide will be readily available. When the amount of carbon dioxide as recovered from the gaseous stream prepared in step (b) is sufficient the amount of nitrogen can be reduced to zero. Nitrogen is suitably prepared in a so-called air separation unit which unit also prepares the oxygen containing stream of step (a).

Figure 2:
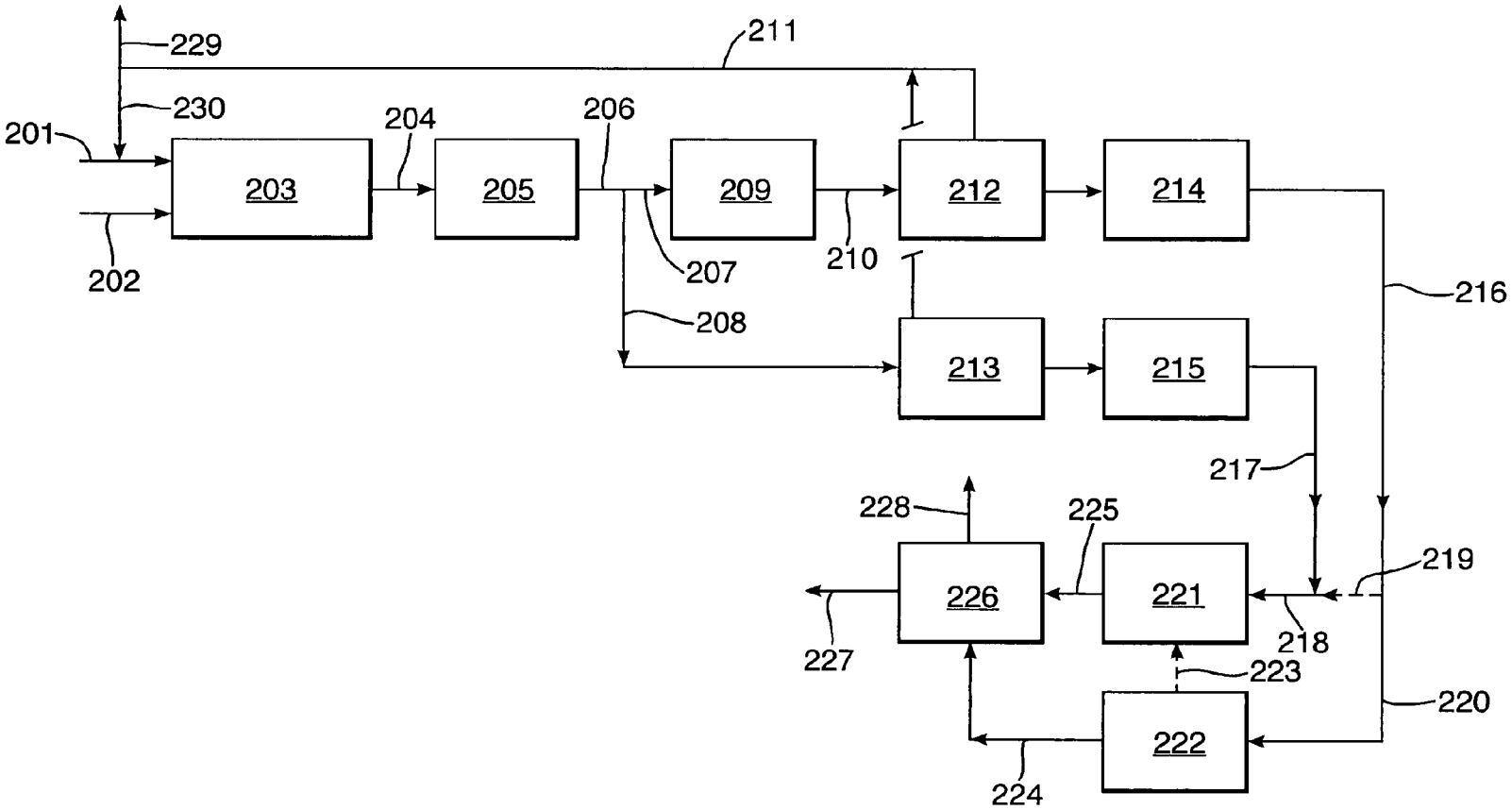
FIG. 2 is a flow diagram of a first arrangement for the method of the present invention.

Turning to FIG. 2, there is shown a process for the synthesis of hydrocarbons from coal. This starts with the gasification in a gasification reactor 203 of coal 201 with oxygen 202 to form a syngas stream 204, followed by removal of solids such as slag and soot and the like in a step 205. Step 205 is a schematic representation of the slag outlet 5, the dry-solids removal unit 12 and scrubber 16 of FIG. 1, wherein further line 204 corresponds to line 11 of FIG. 1. The syngas stream 206 is then divided into two streams 207 and 208. Stream 208 is a 'by-pass' stream, which passes through a $CO_2/H_2S$ removal system 213 followed by one or more guard beds and/or scrubbing units 215 to provide a cleaned sub-stream 217. The units 215 serve as backup or support to the $CO_2/H_2S$ removal system 213, or to assist in the reduction and/or removal of other contaminants such as HCN, $NH_3$, COS and $H_2S$.

The other stream 207 of syngas passes into a sour shift unit 209 to undergo a catalytic water shift conversion reaction wherein the $H_2/CO$ ratio is significantly increased, optionally in a manner known in the art. The gas stream from the sour shift unit then undergoes the same or similar $CO_2/H_2S$ removal in unit 212, followed by the same or similar guard beds 214 as the syngas stream 208. A first CO depleted stream 216 is obtained. Carbon dioxide as separated may be fed to carbon dioxide discharge line 211. At least part 230 of the CO2 is used as transport gas and excess CO2 229 may be used otherwise, for example as shown above with reference to FIG. 1.

The first CO depleted syngas stream 216 may be recombined via stream 219 with the non-converted cleaned syngas sub-stream 217 in case the Fischer-Tropsch process is a cobalt catalyzed based process. In case of an iron based Fischer-Tropsch process the first CO depleted stream 216 does not necessarily need to be combined. Instead stream 216 may be used as feed 220 to a hydrogen purification unit 222 from which purified hydrogen streams 223 and 224 are discharged. A second CO depleted stream 218 is used as feed to Fischer-Tropsch reactor system 221, which may involve one or more reactors or units in one or more stages. In system 221 a hydrocarbon product 225 is obtained which may be further processed in upgrading unit 226 to obtain among other products a middle distillate, like kerosene and gas oil. Unit 226 may involve flashing, distillation, hydrogenation and hydroconversion, like hydrocracking, hydroisomerisation and catalytic dewaxing. A Fischer-Tropsch off-gas 228 will be obtained from which carbon dioxide can be isolated.

Hydrogen 223 and 224 as prepared in unit 222 may be used in the Fischer-Tropsch synthesis and preferably in the various hydroprocessing steps of unit 226.

Figure 3:
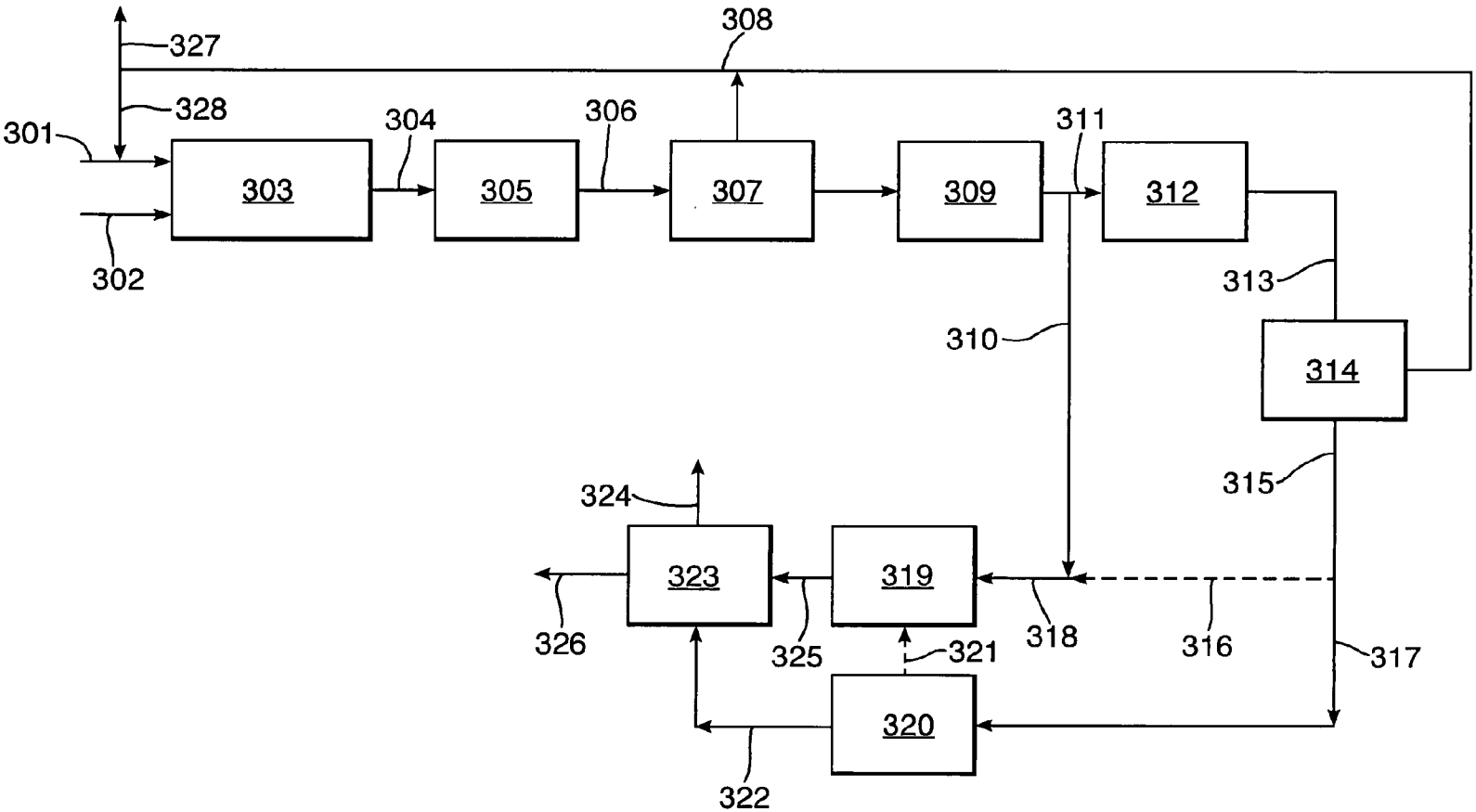
FIG. 3 is of a flow diagram of a second arrangement of the method of the present invention.

FIG. 3 shows a similar process to FIG. 2. However, in the process shown in FIG. 3, the $CO_2/H_2S$ removal unit 307 provides the $CO_2/H_2S$ cleaning of the syngas stream 306 prior to division into streams 311 and 310. After the $CO_2/H_2S$ removal unit 307 and guard beds 309, the syngas stream is then divided into 311 and 310, such that stream 310 passes directly towards the Fischer-Tropsch system 319. Meanwhile, the other divided syngas stream 311 undergoes a sweet shift conversion 312, followed by subsequent $CO_2/H_2S$ cleaning 314, which should not need to treat for $H_2S$. The converted sweet shift stream 315 (first CO depleted stream) may then be wholly or substantially combined with the non-converted by-pass stream to provide a syngas stream 318 entering the Fischer-Tropsch system 319 with an enhanced the $H_2/CO$ ratio as desired for cobalt based Fischer-Tropsch reactions. In case of an iron based Fischer-Tropsch process 319 line 316 may be omitted as explained above.

Like FIG. 2, a part or all of the first CO depleted stream 317 could be supplied to a hydrogen purification unit 320 to make hydrogen 321 and 322. The remaining referrals of FIG. 3 have the meaning of the respective referrals of FIG. 2 as follows: 304 is as 204; 305 is as 205; 325 is as 225; 323 is as 226; 326 is as 227; 324 is as 228; 308 is as 211; 327 is as 229; 328 is as 230.

The invention will be illustrated by the following example.

EXAMPLE 1

The following Table I illustrates, in a line up as shown and described with reference to FIG. 1, the effect of using $CO_2$ from the $CO_2$-recovery system 22 for coal feeding and blowback purposes, instead of nitrogen, on the synthesis gas composition. The synthesis gas capacity (CO and $H_2$) was 72600 $NM^3$/hr, but any other capacity will do as well. The middle column gives the composition of the synthesis gas exiting from wet scrubber 16 when $CO_2$-rich feedback gas from the $CO_2$-recovery system 22 was utilized for coal feeding into the gasification reactor 10, and blow back of the dry-solids removal unit 12. The right hand column gives a reference where $N_2$ was used instead of the feedback gas.

TABLE I

| composition (in wt. %) | | |
|---|---|---|
| | $CO_2$ Feedback gas (inv.) | $N_2$ based (reference) |
| $CO + H_2$ | 89.3 | 87.8 |
| CO | 69.6 | 64.1 |
| $H_2$ | 19.7 | 23.7 |
| $N_2$ | 0.44 | 4.84 |
| $CO_2$ | 9.29 | 6.42 |
| $H_2S$ | 0.44 | 0.67 |
| $H_2O$ | 18.8 | 18.8 |

As can be seen, the nitrogen content in the synthesis gas is decreased by more than a factor of ten utilizing the invention relative to the reference. The $CO_2$ content has increased a little relative to the reference, but this is considered to be of minor importance relative to the advantage of lowering the nitrogen content because $CO_2$ does not burden the Fischer-Tropsch synthesis reaction as much as nitrogen. Moreover CO2 will always be part of the synthesis gas composition, especially after performing a water shift reaction.

EXAMPLE 2

The following Table II illustrates, in a line up as shown and described with reference to FIG. 1, the effect of using a weight ratio of $CO_2$ to the solid coal fuel of less than 0.5 (dense phase) according to the invention (T1-T3), as compared with the weight ratio of about 1.0 (dilute phase) as used in the Example I of U.S. Pat. No. 3,976,442. As can be seen from Table II, the oxygen consumption per kg oxygen according to the present invention is significantly lower than the oxygen consumption in case of Example I of U.S. Pat. No. 3,976,442. Preferably the weight ratio of $CO_2$ to coal is between 0.12 and 0.20.

TABLE II

| influence of weight ratio of $CO_2$ to the carbonaceous fuel | | | | |
|---|---|---|---|---|
| | T1 | T2 | T3 | Example I of U.S. Pat. No. 3,976,442 |
| Weight ratio of $CO_2$ to coal | 0.14 | 0.19 | 0.29 | 1.0 |

TABLE II-continued influence of weight ratio of $CO_2$ to the carbonaceous fuel

| | T1 | T2 | T3 | Example I of U.S. Pat. No. 3,976,442 |
|---|---|---|---|---|
| $CO + H_2$ [mol %] | 95.8 | 89.9 | 87.6 | 83.76 |
| CO [mol %] | 77.3 | 72.0 | 72.2 | 67.46 |
| $H_2$ [mol %] | 18.5 | 17.9 | 15.4 | 16.30 |
| $N_2$ [mol %] | 0.5 | 0.4 | 0.4 | 0.58 |
| $CO_2$ [mol %] | 1.8 | 4.8 | 6.4 | 13.03 |
| $H_2S$ [mol %] | 0.1 | 0.1 | 0.1 | 1.65 |
| $H_2O$ [mol %] | 1.7 | 4.6 | 5.3 | Not indicated |
| $O_2$/Coal [kg/kg] | 0.734 | 0.748 | 0.758 | 0.901 |

What is claimed is:

1. A process for preparing a hydrocarbon product from a solid carbonaceous fuel, the process comprising the steps of:

(a) supplying a solid carbonaceous fuel and an oxygen containing stream to a burner of a gasification reactor, wherein a $CO_2$ containing transport gas is used to transport the solid carbonaceous fuel to the burner wherein the weight ratio of $CO_2$ to the carbonaceous fuel in step (a) is less than 0.3 on a dry basis;

(b) partially oxidising the carbonaceous fuel in the gasification reactor, thereby obtaining a gaseous stream comprising CO, $CO_2$, and $H_2$;

(c) removing the gaseous stream obtained in step (b) from the gasification reactor;

(d) optionally shift converting at least part of the gaseous stream as obtained in step (c) thereby obtaining a CO depleted stream; and (e) subjecting the gaseous stream of step (c) and/or the optional CO depleted stream of step (d) to a Fischer-Tropsch reaction to obtain a hydrocarbon product.

2. The process according to claim 1, wherein the $CO_2$ containing stream supplied in step (a) is supplied at a velocity of less than 20 m/s.

3. The process according to claim 1, wherein the weight ratio in step (a) is in the range from 0.12-0.2.

4. The process according to claim 1, wherein the gaseous stream obtained in step (c) comprises from 1 to 10 mol % $CO_2$ on a dry basis.

5. The process according to claim 1, wherein the solid carbonaceous fuel is coal.

6. The process according to claim 1, wherein the process further comprises the step of subjecting the CO depleted stream as obtained in step (d) to a $CO_2$ recovery system thereby obtaining a $CO_2$ rich stream and a $CO_2$ poor stream and wherein the $CO_2$ poor stream is used in step (e).

7. The process according to claim 6, wherein the $CO_2$ recovery system is a combined carbon dioxide/hydrogen sulfide removal system wherein methanol is the physical solvent.

8. The process according to claim 6, wherein the $CO_2$ rich stream is at least partially used as the $CO_2$ containing transport gas in step (a).

9. The process according to claim 1, wherein the $H_2$/CO ratio in the gaseous stream obtained in step (b) is less than 1.

10. The process according to claim 1, wherein the $H_2$/CO ratio of the CO depleted stream is between 1.4 and 1.95.

11. The process according to claim 10, wherein the gaseous stream obtained in step (b) is divided into at least two sub-streams, one of which undergoes step (d) to obtain a first CO depleted stream and wherein the first CO depleted stream is combined with the second sub-stream to form a second CO depleted stream.

12. The process according to claim 11, wherein the ratio of the sub-stream which undergoes step (d) and the sub-stream which does not undergo step (d) is in the range 70:30 to 30:70 by volume.

13. A method as claimed in claim 1, wherein up to 10% by volume of the CO depleted stream is used for hydrogen manufacture.

14. The process according to claim 1, wherein step (e) is performed by an iron catalyzed Fischer-Tropsch synthesis reaction performed in a slurry phase reactor.

15. The process according to claim 1, wherein step (e) is performed by a multi-stage Fischer-Tropsch process.

16. The process according to claim 15, wherein part of the CO depleted stream is used as additional feed for the further stages in the Fischer-Tropsch process.

17. The process according to claim 1, wherein the hydrocarbon product obtained in step (e) is subjected to a hydroprocessing step to obtain a middle distillate fuel.

18. The process according to claim 17, wherein the hydrogen made from part of the CO depleted stream is used in the hydroprocessing step.

19. The process according to claim 1, wherein the weight ratio in step (a) is in the range from 0.14-0.29.

20. The process according to claim 1, wherein the weight ratio in step (a) is less than 0.2.

21. The process according to claim 1, wherein the weight ratio in step (a) is less than or equal to 0.14.

* * * * *